US006435641B1

(12) United States Patent
Tung et al.

(10) Patent No.: US 6,435,641 B1
(45) Date of Patent: Aug. 20, 2002

(54) MEDIA MOVEMENT APPARATUS

(75) Inventors: Victor Tung; Pierre Joseph Kaiser; Matthew A. Shepherd, all of Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 24 days.

(21) Appl. No.: 09/651,698

(22) Filed: Aug. 30, 2000

(51) Int. Cl.[7] ..... B41J 29/38; B41J 2/01; B41J 29/44

(52) U.S. Cl. ..... 347/16; 347/104; 400/706

(58) Field of Search ..... 347/16, 104; 400/509, 400/630, 706

(56) References Cited

U.S. PATENT DOCUMENTS

| | | | | |
|---|---|---|---|---|
| 5,252,991 A | | 10/1993 | Storlie et al. | 346/108 |
| 5,466,079 A | * | 11/1995 | Quintana | 347/104 |
| 5,521,674 A | | 5/1996 | Guillory et al. | 355/200 |
| 5,561,449 A | | 10/1996 | Raskin et al. | 347/37 |
| 5,563,686 A | | 10/1996 | Beaufort et al. | 355/206 |
| 5,564,848 A | | 10/1996 | Quintana | 400/708 |
| 5,580,046 A | | 12/1996 | Beaufort et al. | 271/3.16 |
| 5,738,457 A | * | 4/1998 | Ishida et al. | 400/706 |
| 5,856,833 A | | 1/1999 | Elgee et al. | 347/19 |
| 5,969,371 A | | 10/1999 | Andersen et al. | 250/559.15 |
| 6,005,683 A | | 12/1999 | Son et al. | 358/488 |

OTHER PUBLICATIONS

Hewlett–Packard Patent Application filed on Jun. 2, 2000, Ser. No. 09/587,490, Single Transmission State Media Handling For Ejecting, Picking and Loading.

* cited by examiner

*Primary Examiner*—John Barlow
*Assistant Examiner*—An H. Do

(57) ABSTRACT

An embodiment of a media movement apparatus is used to detect an edge of a unit of media in a media path in an inkjet printer using an optical sensor. When the inkjet printer is operating in a mode in which units of media are continuously moved into the media path, a mechanical sensor will not reliably allow detection of the leading edge of a unit of media. Determining the location of the leading edge of the unit of media is done to correctly place an image on the unit of the media. After ejecting the previous unit of the media into an output tray, the current unit of the media is moved backward in the media path while measuring the output of an optical sensor. If the edge is detected while moving backward, the current unit of the media is moved to the input side of a print zone. If the edge is not detected and the optical sensor indicates the presence of media, a media jam is indicated. If the edge is not detected and the optical sensor indicates the absence of media, the current unit of the media is moved forward while measuring the output of the optical sensor to detect the edge. If the edge is detected, then the current unit of the media is moved forward a predetermined distance. Next, the current unit of the media is moved backward in the media path while measuring the output of the optical sensor.

18 Claims, 13 Drawing Sheets

MEDIA MOVEMENT APPARATUS

FIELD OF THE INVENTION

This invention relates to the formation of images on media. More particularly this invention relates to the movement of media in a media path.

BACKGROUND OF THE INVENTION

Typically, in imaging devices, such as inkjet printers, units of media are loaded sequentially into a media path so that after a first unit of media is moved into the media path, a second unit of the media is not moved into the media path until an imaging operation is completed on a first unit of media. One way in which throughput in an imaging device can be defined is as the average rate at which units of media move through the media path during an imaging operation. The time delay between a trailing edge of the first unit of the media and a leading edge of a second unit of the media contributes to a reduction in the throughput of the inkjet printer because this time delay can correspond to a substantial portion of the length of a unit of media. To improve the throughput of the inkjet printer, successive units of the media can be moved into the media path so that the time delay between the trailing edge of the first unit of the media and the leading edge of the second unit of the media is reduced. Operating in this mode can introduce difficulties in the process of moving media through the media path. A need exists for a way in which control the movement of media through the media path in an imaging device while operating in a mode in which successive units of media are rapidly loaded into the media path.

SUMMARY OF THE INVENTION

Accordingly, a method for locating an edge of media in an inkjet imaging device has been developed. The method includes moving the media backward in the media path and making a plurality of measurements of light reflected from within the media path while moving the media. The method also includes stopping movement of the media if the plurality of measurements indicates detection of the edge.

An apparatus to move media in an inkjet imaging device includes a sensor configured to measure light reflected from the media. The apparatus also includes a media movement mechanism configured to move the media in a media path. Furthermore, the apparatus includes a processing device arranged to receive a plurality of measurements of light reflected from within the media path from the sensor and configured to command the media movement mechanism to selectively move the media backward or forward in the media path to detect an edge of the media using the plurality of measurements.

An imaging device includes a printhead to eject ink onto media and a printhead controller configured to provide a signal to the printhead to eject ink according to image data. The imaging device further includes a sensor configured to measure light reflected from the media and a media movement mechanism configured to move the media in a media path. The imaging device also includes a processing device arranged to receive a plurality of measurements of light reflected from within the media path from the sensor and configured to command the media movement mechanism to selectively move the media backward in the media path or forward in the media path dependent upon the sensor indicating an absence of the media in the media path from the plurality of measurements, and configured to supply the image data to the printhead controller.

DESCRIPTION OF THE DRAWINGS

A more thorough understanding of embodiments of the media movement apparatus may be had from the consideration of the following detailed description taken in conjunction with the accompanying drawings in which.

DETAILED DESCRIPTION OF THE DRAWINGS

Although controlling the movement of media through the media path will be discussed in the context of an inkjet printer, the disclosed principles have applicability in other devices having the capability to form images on media. For example, a fax machine using an inkjet print engine could make use of the disclosed techniques for controlling the movement of media. Or, a scanner-copier using an inkjet print engine could make use of the disclosed techniques for controlling the movement of media. Furthermore, although the disclosed techniques will be discussed in the context of media such as paper, they are applicable to other types of media such as transparencies, envelopes, post cards, and the like.

Figure 1:
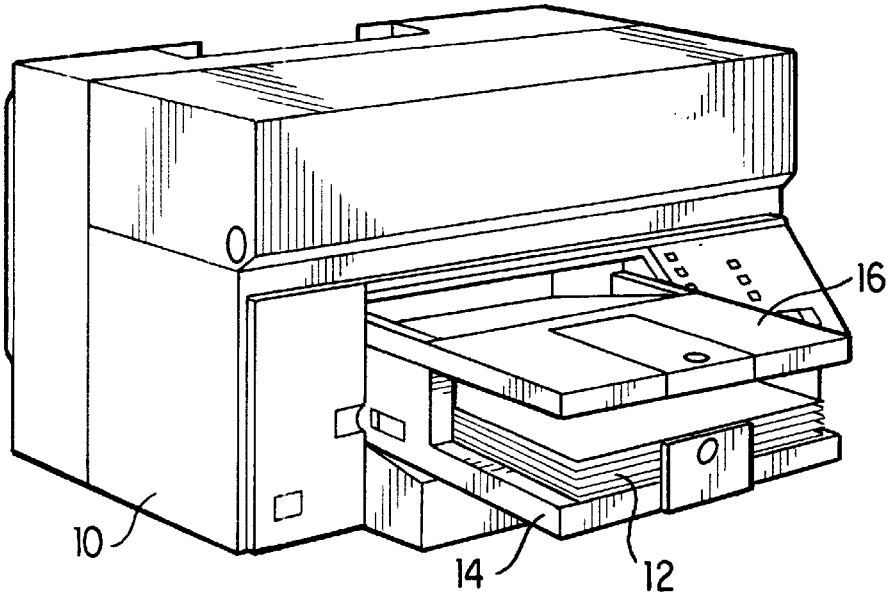
FIG. 1 shows a perspective view of an exemplary inkjet printer.

Shown in FIG. 1 is an exemplary imaging device, inkjet printer 10, in which an embodiment of a media movement apparatus is included. Media, such as paper 12, is stored in an embodiment of a media input device, input tray 14. Units of paper 12 are pulled from input tray 14 and moved through inkjet printer 10. During movement through inkjet printer 10, images are formed onto units of paper 12. After formation of the images, the units of paper 12 are deposited into an embodiment of a media output device, output tray 16.

Figure 2:
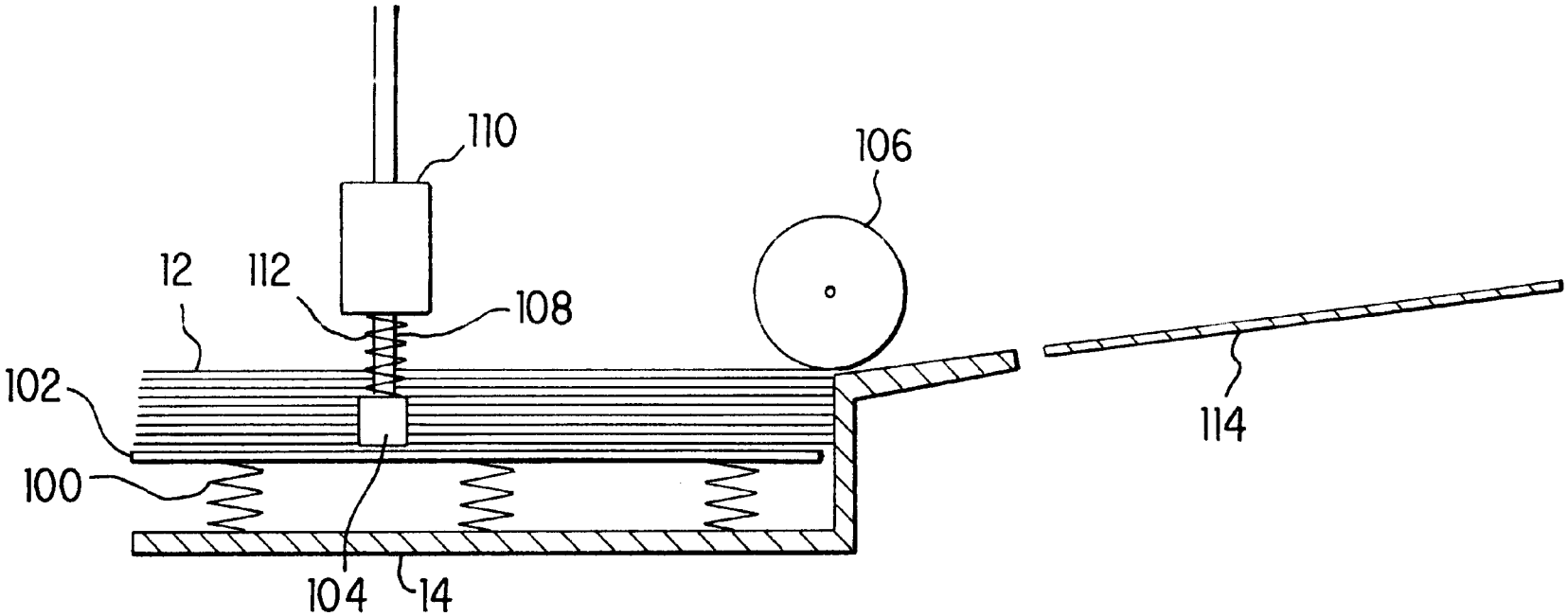
FIG. 2 shows a simplified view of an input tray

Shown in FIG. 2 is a simplified cross sectional view of input tray 14. Input tray 14 includes bias springs, of which bias spring 100 is exemplary, loaded against pressure plate 102. Normally, when inkjet printer 10 is inactive, member 104 holds pressure plate 102 down so that paper 12 is not in contact with pick roller 106 (pick roller 106 is one of multiple pick rollers not shown in FIG. 2). Member 104 is coupled to solenoid shaft 108. The position of solenoid shaft 108 is controlled by solenoid coil 110.

With no power supplied to solenoid coil 110, bias spring 112 forces member 104 against pressure plate 102 pushing it toward the bottom of input tray 14 and moving paper 12 out of contact with pick roller 106. With member 14 pushing pressure plate 102 toward the bottom of input tray 14, rotation of pick roller 106 will not a unit of pull paper 12 into the media path. With power supplied to solenoid coil 110, solenoid shaft 108 is pulled into solenoid coil 110, bias spring 112 is compressed, and member 104 moves upward and out of contact with input tray 14. Moving member 104 out of contact with input tray 14 permits a unit of paper 12 to move into contact with pick roller 106. Rotation of pick roller 106 will then move a unit of paper 12 into the media path. A servo motor within inkjet printer 10 rotates pick roller 106 to move units of paper 12 into the media path at the beginning of an imaging operation. It should be recognized that although one particular mechanism for controlling the position of pressure plate 102 has been disclosed, other mechanisms for controlling the position of pressure plate 102 could be used. For example, a mechanism using a mechanical linkage to control the rotation of a cam contacting pressure plate 102 could be used to control its position.

When units of paper 12 are moved into the media path, they move over guide 114 toward a print zone. The print zone is a region along the media path in which ink can be placed by a cartridge onto units of paper 12 or other media. The print zone is bounded in the dimension substantially perpendicular to the direction units of paper 12 move through the media path by range over which the cartridge can move in this dimension. The print zone is bounded in the dimension substantially parallel to the direction units of paper 12 move through the media path by the size of the swath the cartridge can print in this dimension.

In a first mode of operation of a typical inkjet printer, units of paper 12 are moved into the media path so that in forming images on two successive units of paper 12, the second unit of paper 12 is not moved into the media path until the imaging operation on the first unit of paper 12 is substantially complete. However, in a second mode of operation, inkjet printer 10 has the capability to control the loading of units of paper 12 into the media path so that in forming images on two successive units of paper 12, the second of the two units of paper 12 is moved into the media path shortly after a trailing edge of the first unit of paper is moved into the media path. By controlling the movement of paper 12 into the media path in this fashion, the throughput of inkjet printer 10 in the second mode is increased over the first mode of operation. The throughput is improved because in the second mode of operation there is less distance between the trailing edge of the first unit of paper 12 and the leading edge of the second unit of paper 12 than in the second mode of operation. An example of the second mode of operation in an alternative embodiment of inkjet printer 10 (in which an embodiment of the media movement apparatus could be used) is disclosed in U.S. Pat. No. 6,325,559 issued to Kaser et al, which is incorporated by reference Into this specification in its entirety.

When inkjet printer 10 operates in the second mode, the solenoid coil 110 moves member 104 out of contact with pressure plate 102 holds member 104 in the non-contact position. The servo motor that rotates pick roller 106 to move units of paper 12 into the media path also rotates other rollers (not shown in FIG. 2) within inkjet printer 10) that move units of paper 12 through the media path. Typically, these other rollers are mechanically linked to pick roller 106 so that both are rotating at the same time. When member 104 is held in a position that does not contact pressure plate 102, paper 12 contacts the rotating pick roller 106 and as a result units of paper 12 are loaded into the media path of inkjet printer 10 in relatively rapid succession. The gap between successive units of paper 12 may range from overlap (a negative gap) to up to 6 mm of the length of a unit of paper 12.

Figure 3:
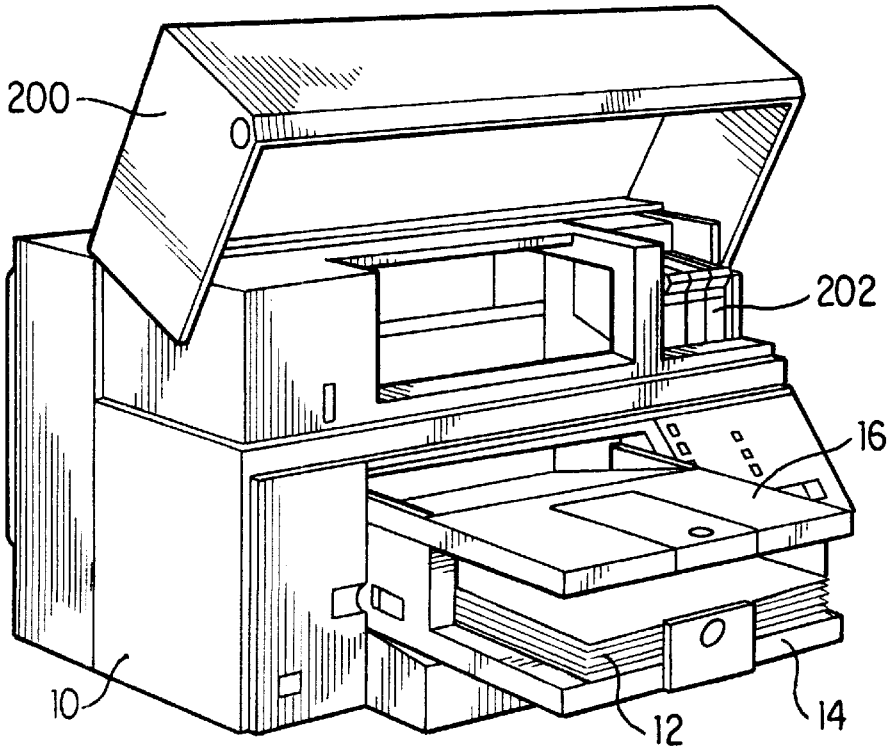
FIG. 3 shows a perspective view of the inkjet printer with the cover lifted.

Shown in FIG. 3 is a second view of inkjet printer 10 with cover 200 raised to display a part of the internal mechanism. When power is not applied to inkjet printer 10, print cartridges, of which print cartridge 202 is exemplary, are positioned outside of the media path. The print cartridges contain ink of the colors necessary for forming an image on media. Typically, there are four print cartridges having cyan, magenta, yellow, and black ink. When the image is formed on the surface of units of paper 12, the print cartridges are moved on a carriage into the media path. Signals are supplied to the print cartridges causing them to eject the color of ink necessary to form the image on the media.

Figure 4:
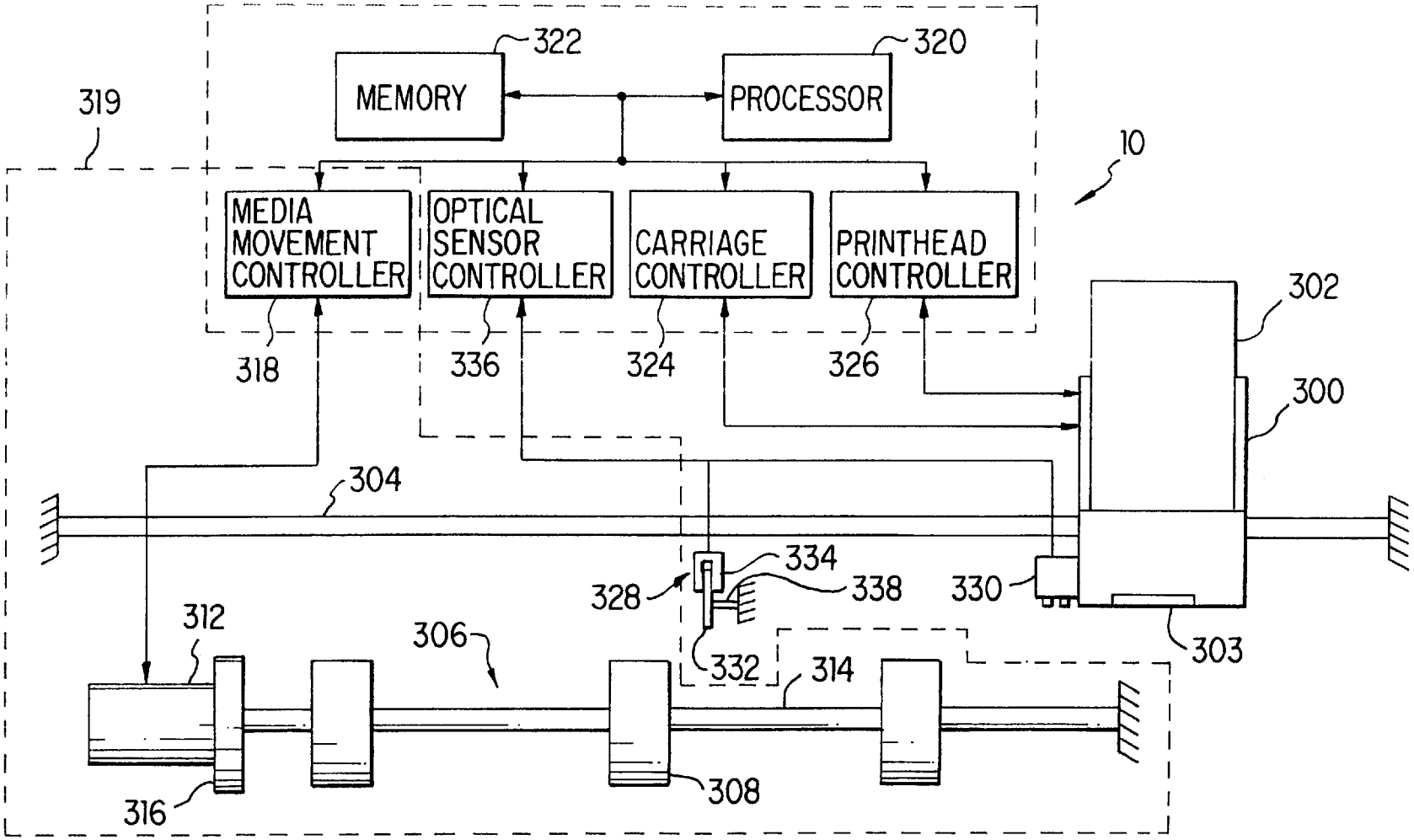
FIG. 4 shows a schematic diagram of the inkjet printer.

Shown in FIG. 4 is a simplified block diagram representing a portion of inkjet printer 10. Carriage 300 holds the print cartridges 302 (the four cartridge colors are shown as a single unit for convenience). Carriage 300 carries print cartridges 302 along guide 304. Not shown in FIG. 4 (to simplify the illustration) is a belt coupled to carriage 300 that moves carriage 300 on guide 304 during the placement of ink onto units of paper 12. The movement of carriage 300 across the media is carefully controlled so that ink ejected from print cartridges 302 is precisely placed on units of paper 12. Each of the cartridges include in print cartridges 302 includes an embodiment of a printhead, printhead 303. The printhead includes resistive elements associated with a corresponding array of nozzles. Supplying power to the resistive elements causes the ejection of ink from the nozzles. Additional detail regarding the construction and operation of printheads can be found in U.S. Pat. No. 6,084,617 issued to Balazer and U.S. Pat. No. 6,039,438 issued to Beerling, each of which are assigned to Hewlett Packard Company and incorporated by reference into this specification.

Units of paper 12 are moved into a print zone (the region along the media path in which print cartridges can direct ink onto media) by an embodiment of a media drive mechanism, media drive mechanism 306. Media drive mechanism 306 includes drive rollers, of which drive roller 308 is exemplary. In addition, media drive mechanism 306 includes pinch rollers (represented in FIGS. 5A and 5B for simplicity of illustration as exemplary pinch rollers 310). Units of paper are moved by pick roller 106 out of input tray 14. The leading edge of units of paper 12 move through the nip region formed between the pinch rollers. A circularly shaped guide (not shown in FIG. 4 for simplicity of illustration) forces units of paper 12 to wrap around the drive rollers to guide it into the nip region between the pinch rollers. Units of paper 12 enter the print zone when the leading edge is moved below print cartridges 302 and over a flat member (shown in FIG. 5A and 5B as pivot 311).

A motor, such as servo motor 312, is coupled to shaft 314 on which the drive rollers are mounted. An encoder, such as rotary position encoder 316 is coupled to a shaft of servo motor 312. Rotary position encoder 316 is used to count the number of steps servo motor 312 rotates in response to a command. The steps are generally some predetermined fraction of a single rotation of the shaft of servo motor 312. The size of the rotational steps will depend on the maximum resolution with which it is desired to make incremental movements of media. The use of rotary position encoder 316 allows precise distance movements of units of paper 12. Rotary position encoder 316 allows counting of the number of incremental movements performed by servo motor 312.

Media movement controller 318 generates the signals applied to servo motor 312 to perform a movement of units of paper 12 a predetermined distance. Servo motor 312, rotary position encoder 316, media movement controller 318, the drive rollers, and the pinch rollers are included in media movement mechanism 319 used to control the forward and backward movement of units of paper 12 in the media path. A processing device, such as processor 320, executes firmware stored in memory 322. The moves that media movement controller 318 commands servo motor 312 to perform are based upon commands received by media movement controller 318 from processor 320 executing the firmware stored in memory 322. In commanding a move of a specific distance at a specific velocity, processor 320 monitors the count provided by rotary position encoder 316 to determine when to begin deceleration to perform a move of the desired distance. Carriage controller 324 controls the movement of carriage 300 by controlling the rotation of another servo motor (not shown in FIG. 4) based upon commands received from processor 320 through the execution of firmware. Carriage 300 is moved across the media path during each printing swath so that ink can be ejected from print cartridges 302 at the necessary locations on units of paper 12 to form images. Printhead controller 326 generates the signals used by print cartridges 302 to eject ink at the correct location on units of paper 12. Processor 320 is coupled to printhead controller 326 and provides the print data used by printhead controller 326 to generate the signals supplied to print cartridges 302.

Inkjet printer 10 includes first sensor, such as media sensor 328, and a second sensor, such as optical sensor 330. Media sensor 328 detects the presence of units of paper 12 or other media at the location in the media path corresponding to the position of media sensor 328 in the media path. Optical sensor 330 is used to measure the intensity of the diffuse lightreflected from the surface of media. Optical sensor 330 is used for the calibration and alignment of print cartridges 302. In addition, optical sensor 330 is used to measure the performance of inkjet printer 10 in forming images on media. Furthermore, optical sensor 330 is used in an embodiment of the media movement apparatus to determine the position of the leading edge of units of paper 12 or other types of media.

Media sensor 328 detects edges of units of paper 12 or other types of media using lever 332 and an optical emitter/detector 334. Media sensor 328 is positioned inside of the media path. When units of paper 12 are not present at lever 332, the optical emitter/detector 334 does not detect reflected light. In response, the detector in optical emitter/detector 334 generates a signal indicating that no light has been detected. The signal generated by optical emitter/detector 334 is coupled to sensor controller 336. Sensor controller 336 generates digital signals that are supplied to processor 320. Sensor controller 336 interprets the signal indicating no detection of light as the absence of units of paper 12 at lever 332. Under firmware control, processor 320 polls sensor controller 336 to determine the state of the sensors. As will be described in more detail later, the states of the sensors will be used in the embodiment of the media movement apparatus.

When the leading edge of a unit of paper 12 contacts lever 332, it rotates about pivot 338. When lever 332 rotates after contacting the leading edge of a unit of paper 12, light is reflected off lever 332 and detected by optical emitter/detector 334. In response, emitter/detector 334 generates a signal indicating that light has been detected. Sensor controller 336 interprets this signal to indicate the presence of a unit of paper 12 at lever 332 and generates a digital signal indicating that media sensor 328 has detected a unit of paper 12.

When the trailing edge of the unit of paper 12 passes the position of lever 332 in the media path, lever 332 rotates back into its position without units of paper 12 in the media path. In response, sensor controller 336 generates a digital signal indicating that media sensor 328 does not detect the presence of a unit of paper 12.

Although media sensor 328 is of a mechanical-optical type, it should be recognized that other types of sensors could be used. For example, a sensor having an optical emitter/detector positioned above and below the media path could be used. The important functional characteristic of media sensor 328 is its ability to detect the presence or absence of media at a location in the media path. In addition, although media sensor 328 is positioned near the edge of the media path, it could be located at other positions across the width of the media path.

Optical sensor 330 is used to measure light reflected from the surface of units of paper 12 for a calibration and alignment of print cartridges 302. Performing this alignment involves the placement of a pattern on a unit of paper 12 and measuring the intensity of light reflected from the surface. For purposes of performing the calibration and alignment, optical sensor 330 measures diffuse and specular light reflected from the surface of units of paper 12. Optical sensor 330 generates analog signals corresponding to the measured specular and diffuse reflected light. The analog signals are converted to digital signals by an analog to digital (A/D) converter included within sensor controller 336. The output of the A/D converter represents the intensity of the reflected light measured by optical sensor 330. As will be discussed in more detail below, optical sensor 330 is used in an embodiment of the media movement apparatus to detect the presence of media at the location of optical sensor 330 within the media path.

Figure 5A:
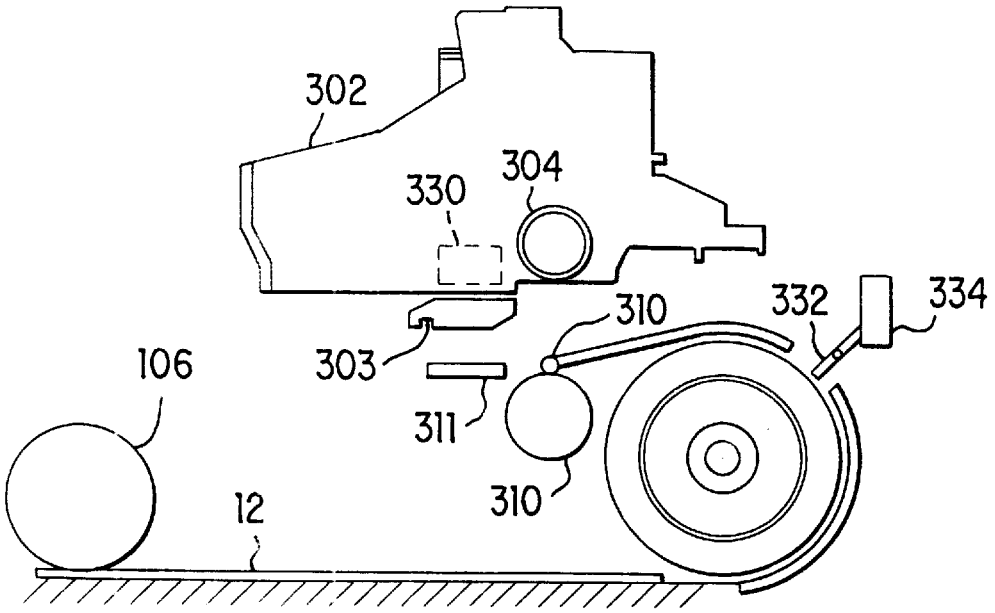
FIGS. 5A and 5B show a simplified view of the media path in the inkjet printer.
Figure 5B:
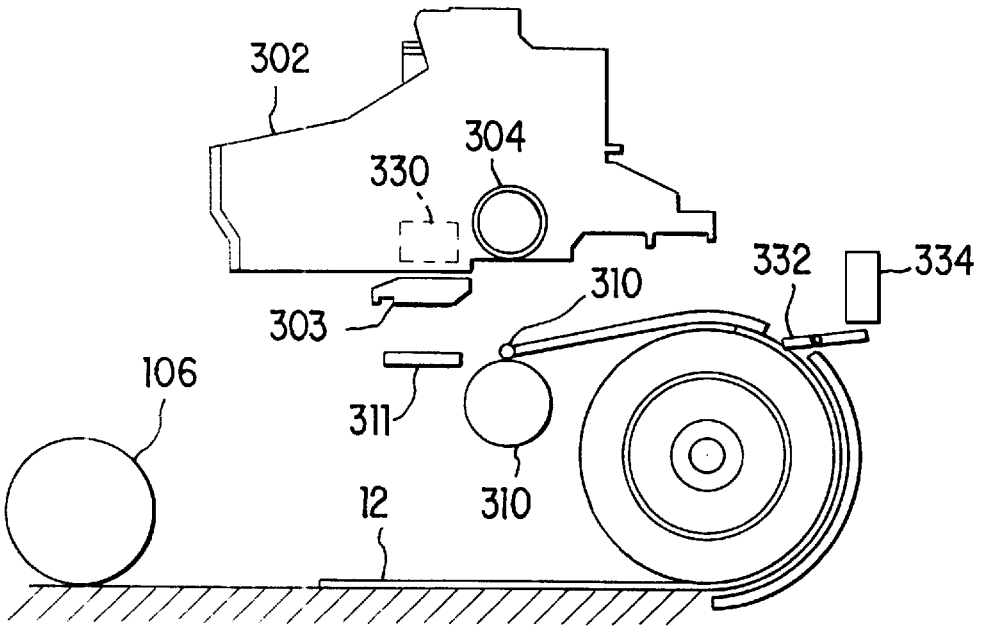
Figure 6A:
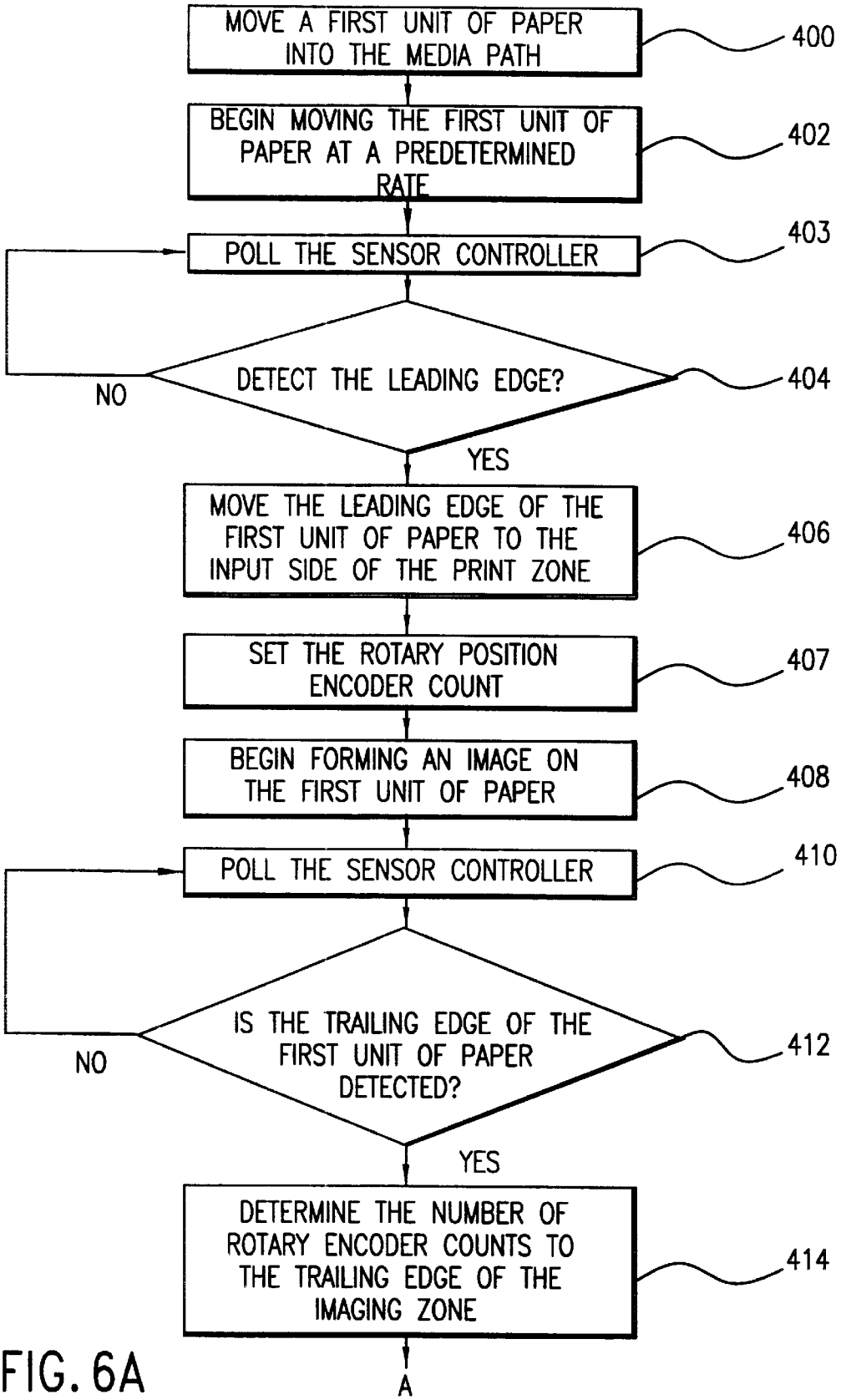
FIGS. 6A–6H show a high level flow diagram of a method for using an embodiment of the media movement apparatus to detect an edge
Figure 6B:
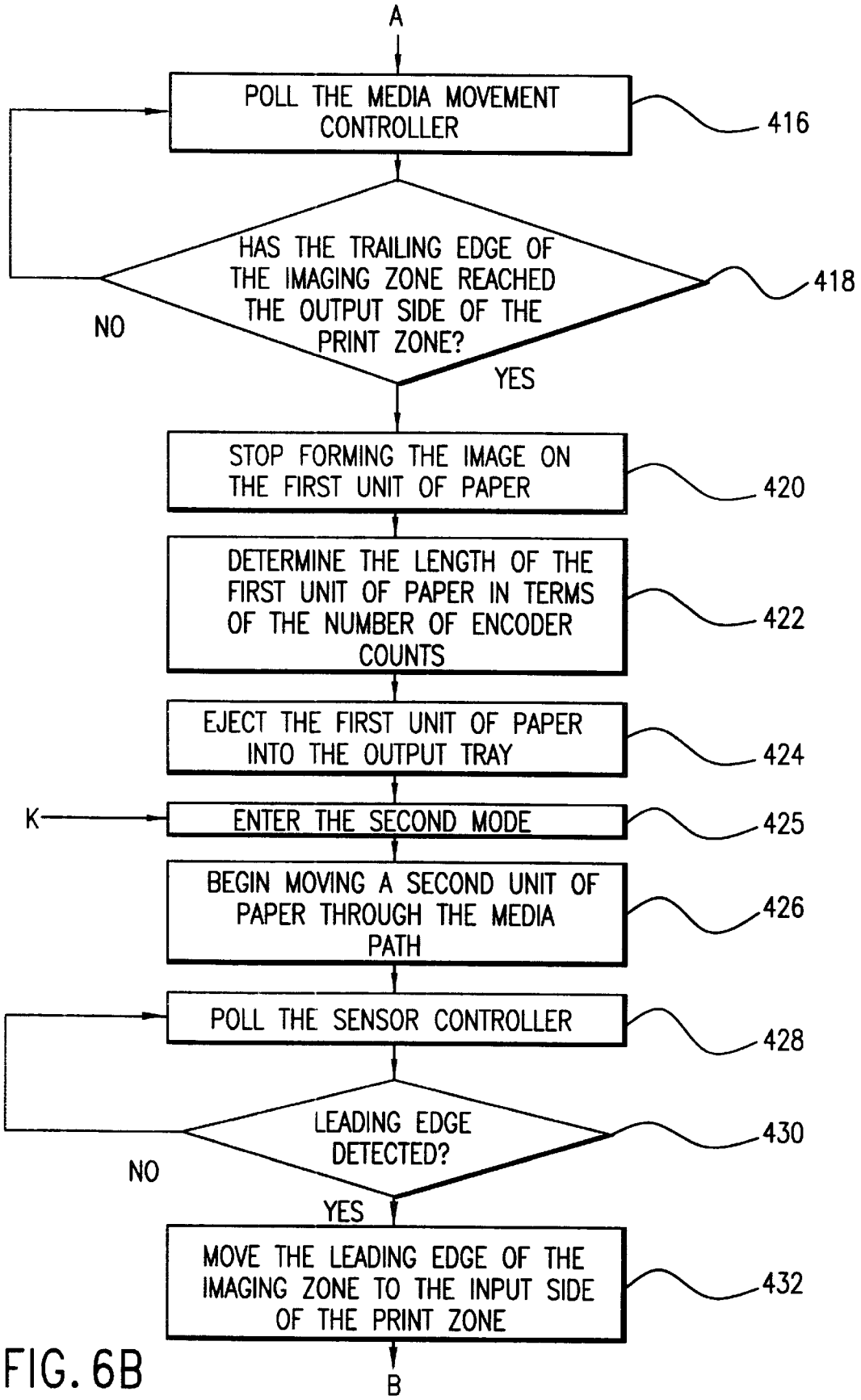
Figure 6C:
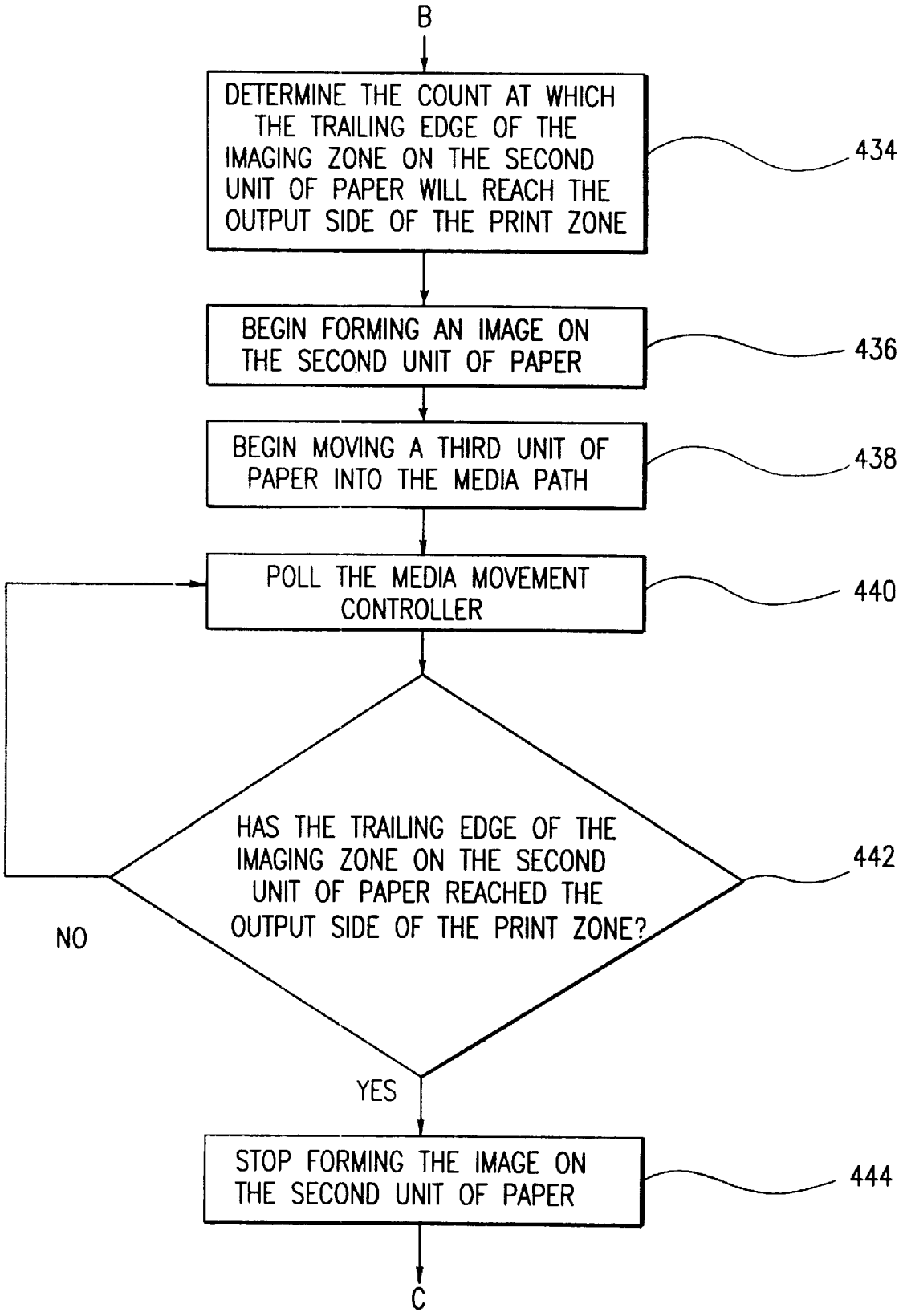
Figure 6D:
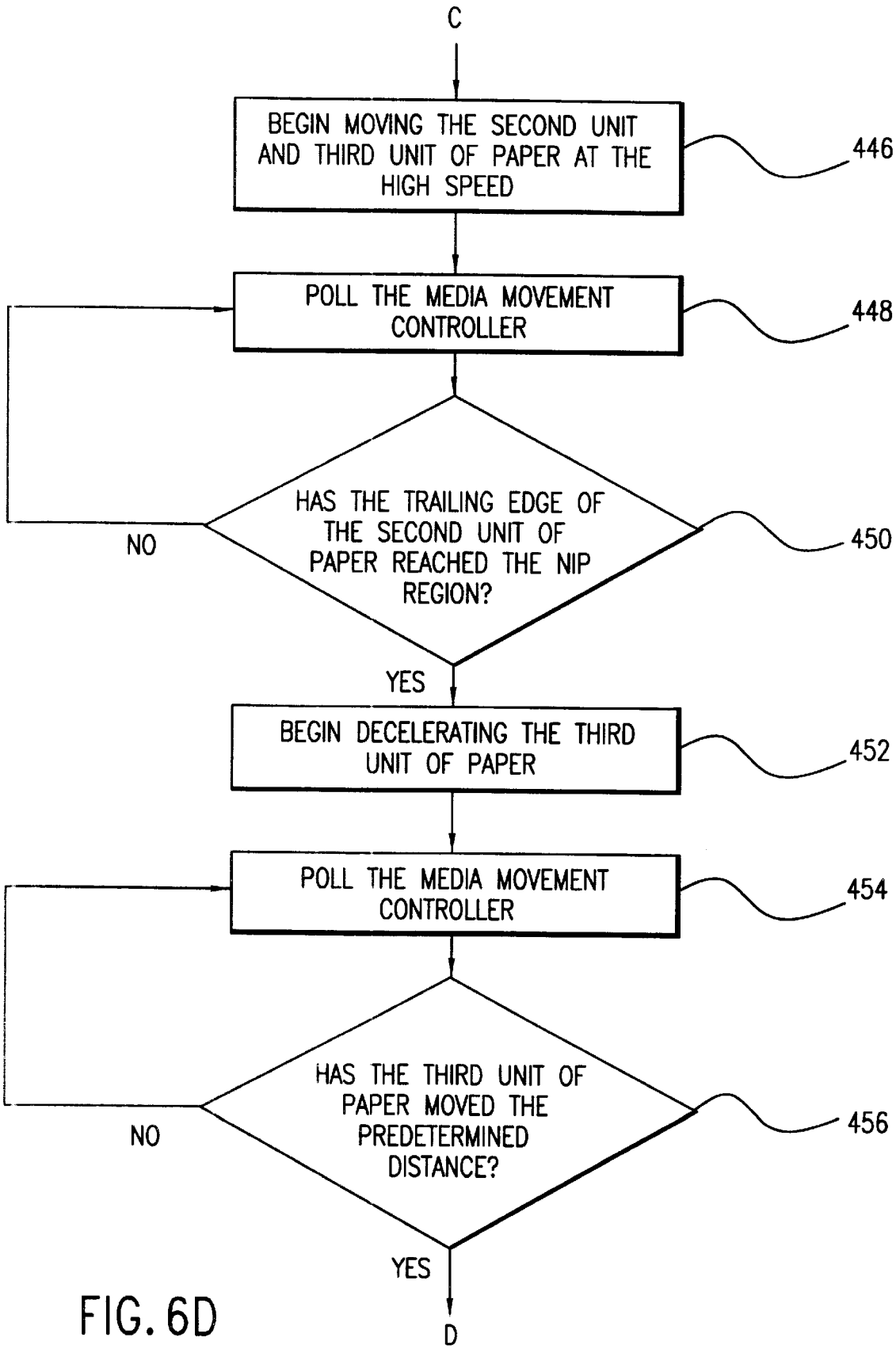
Figure 6E:
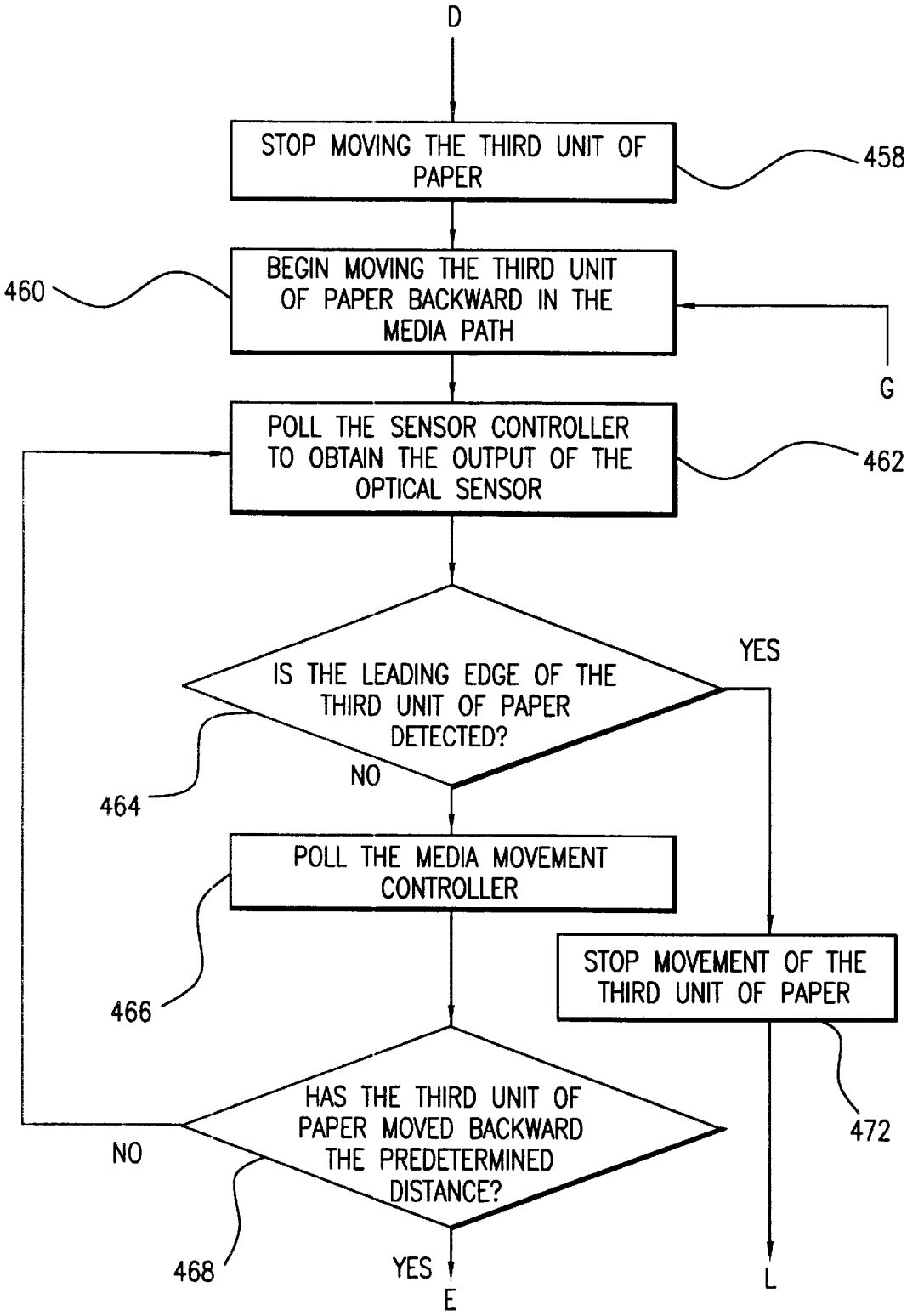
Figure 6F:
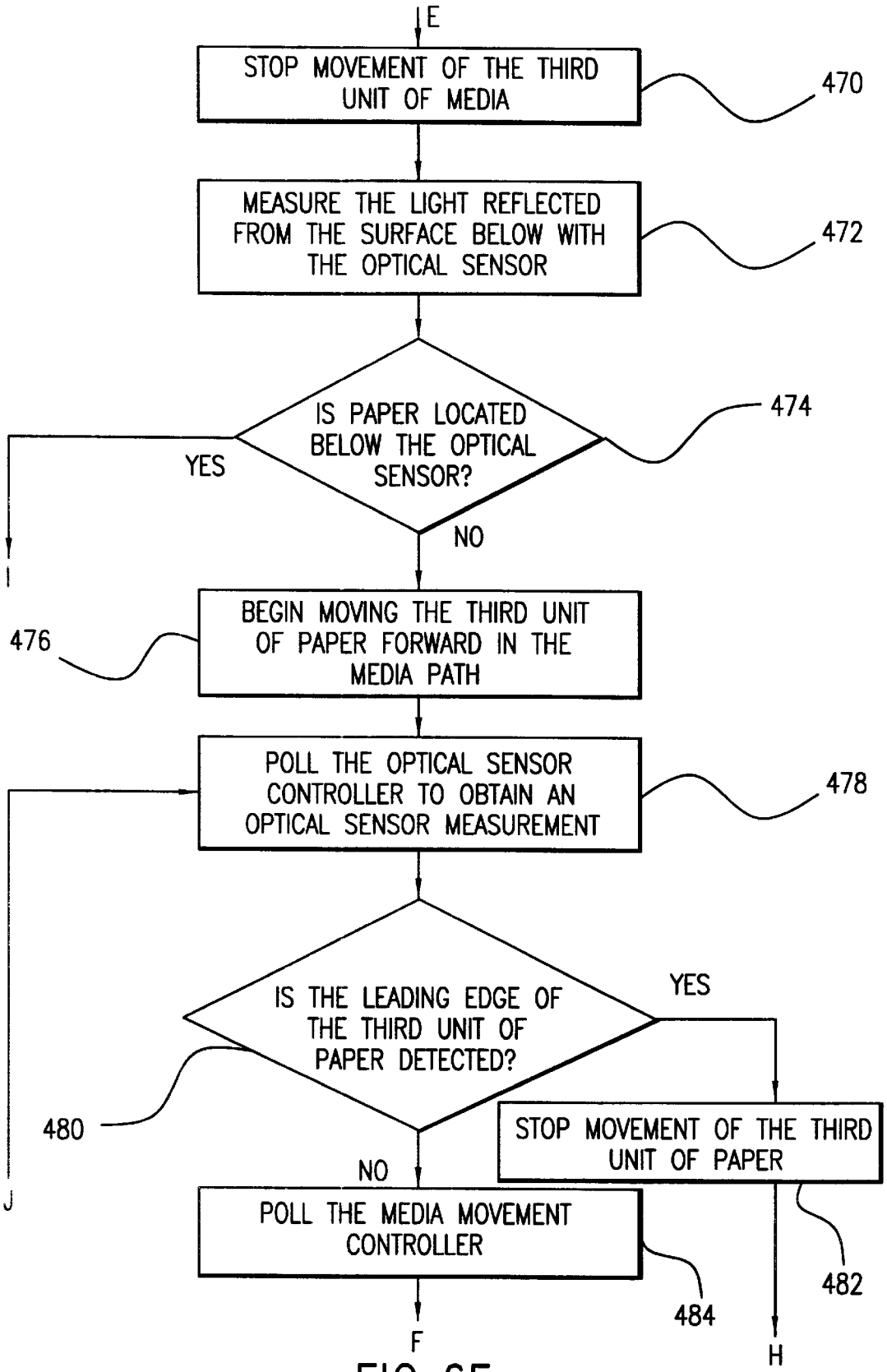
Figure 6G:
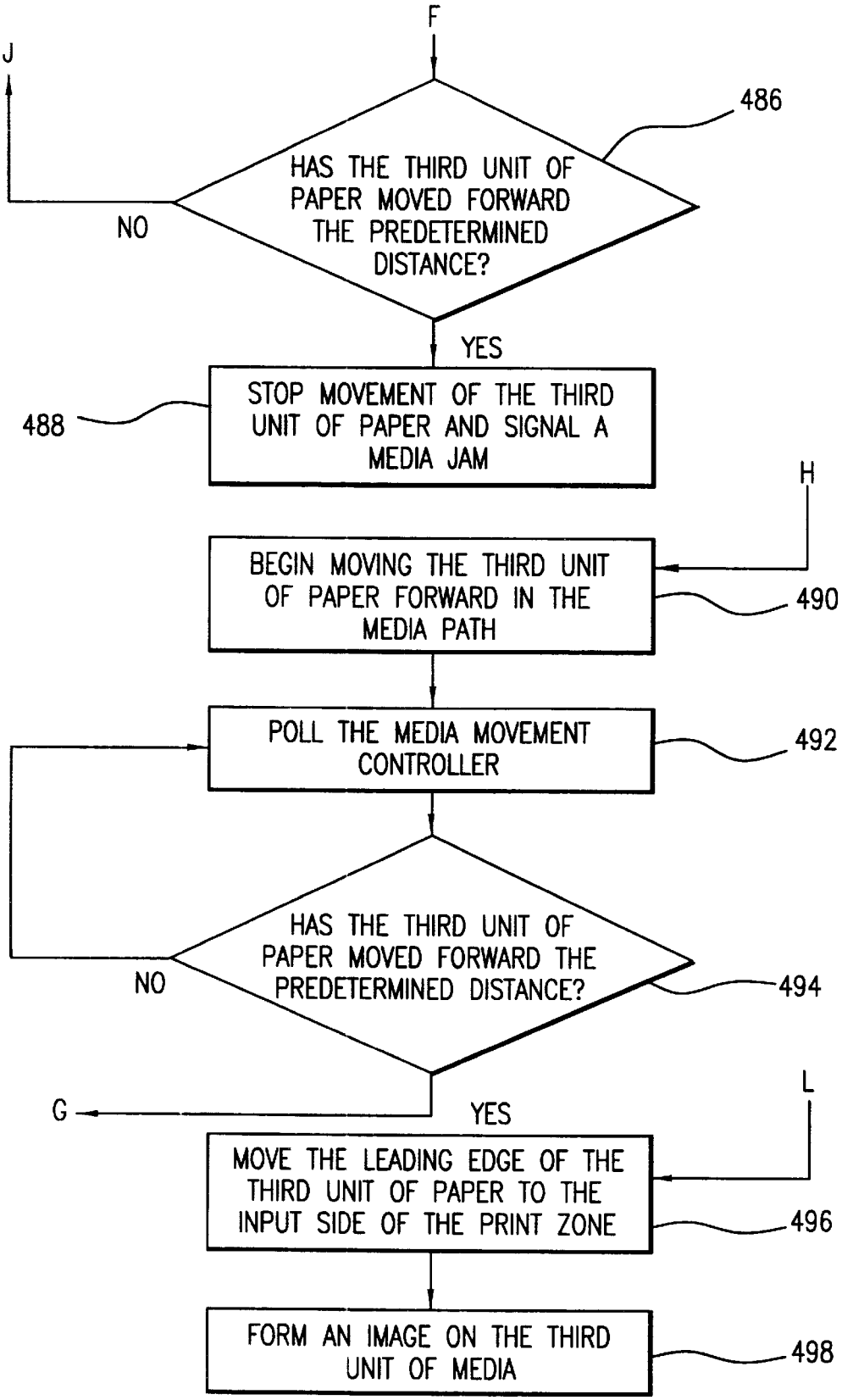
Figure 6H:
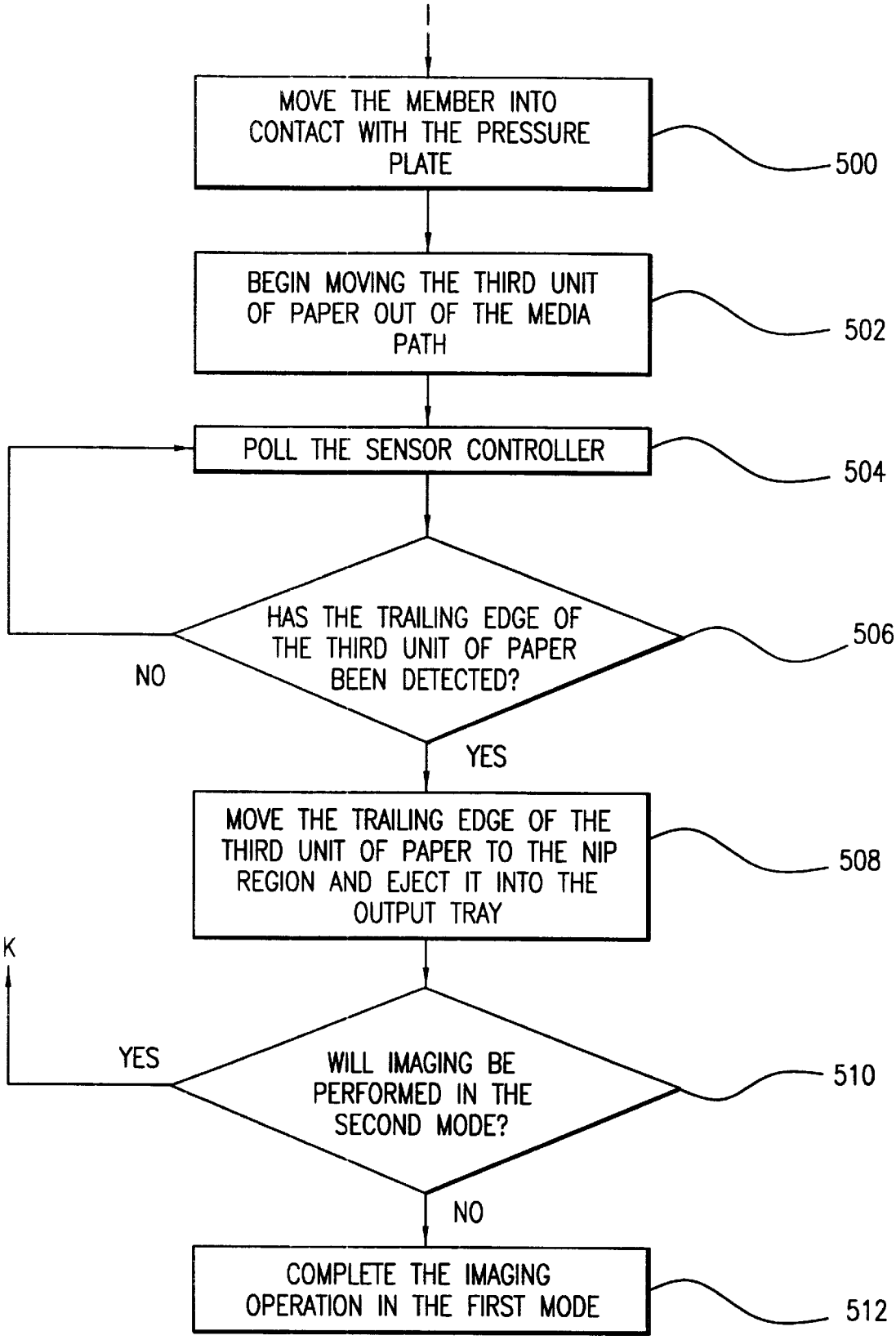

Shown in FIG. 5A and FIG. 5B are simplified views of components associated with the media path in inkjet printer 10. FIG. 5A and FIG. 5B are included for the purpose of illustrating the spatial relationship between pick roller 106, media sensor 328, optical sensor 330, drive roller 308, pinch roller 310, and pivot 311. In addition, FIG. 5A shows the position of lever 332 before contact by the leading edge of a unit of paper 12. FIG. 5B shows the position of lever 332 after contact by the leading edge of a unit of paper 12. Guide 340 directs units of paper 12 around the circumference of the drive rollers and into the nip region between the pinch rollers.

Consider an imaging operation performed on a unit of paper 12 in the first mode. After a unit of paper 12 is moved into the media path, processor 320, under firmware control, begins polling sensor controller 336 to determine if media sensor 328 has detected the presence of a unit of paper 12. The position of the unit of paper 12 in the media path when media sensor 328 first indicates the presence of the unit of paper 12 establishes the position of the leading edge. When the polling of sensor controller 336 by processor 320 indicates that media is present at lever 332, then processor 320 signals media movement controller 318 to stop rotation of servo motor 312. The more rapidly sensor controller 336 is polled, the more accurately the position of the leading edge of the unit of paper 12 can be ascertained. Polling every 1.6 ms has been found to locate the leading edge with sufficient accuracy.

After determining the leading edge position of the unit of paper 12, processor 320 commands media movement controller 318 to rotate servo motor 312 to advance the unit of paper 12 in the media path a predetermined distance. This predetermined distance corresponds to the distance necessary to move the leading edge of the unit of paper 12 to the input side of the print zone. Typically, the imaging operation in the first mode is performed by advancing the unit of paper 12 to a location in the print zone corresponding to the image that will be formed on that swath of the unit of paper 12, moving carriage 300 and print cartridges 302 across the swath while ejecting ink to form the image on that swath, and then advancing the unit of paper 12 in the media for forming the image on the next swath. When the polling of sensor controller 336 by processor 320 indicates that the trailing edge of the unit of paper 12 has passed lever 332, this establishes the location of the trailing edge of the unit of paper 12. Determining the location of the trailing edge allows processor 320 to stop the placement of ink on the unit of paper 12 at the correct predetermined distance before the trailing edge. This may involve clipping of the image or the image may completely fit onto the unit of paper 12. After the trailing edge of the unit of paper 12 has passed through the print zone, an ejection mechanism ejects the unit of paper 12 into output tray 16.

Operation in the second mode provides a substantial improvement in the throughput at which images can formed on units of paper 12. However, there are several potential problems that can occur with operation in the second mode. As previously mentioned, in operation in the second mode, the spacing between successive units of paper 12 is variable. When operating in this second mode, there is a need to eject the current unit of paper 12 after completing the imaging operation before the second unit of paper 12 moves into the print zone. If the current unit is not moved forward in the media path, there is a possibility that a media jam may result. Media jams may occur because the media ejection process used for the first mode of operation does not work in the second mode of operation. Media jams are avoided by rapidly moving a unit of media upon which imaging has been performed out of the media path.

Another difficulty arising in performing imaging operations in the second mode is in locating the leading edge and the trailing edge. Performing imaging operations in the second mode does not rely exclusively upon media sensor 328 to locate the leading edge of units of paper 12. The gap between successive units of paper 12 while operating in the second mode will be, in many cases, to small to permit the trailing edge of the earlier unit of paper 12 or the leading edge of the later unit of paper 12 to be detected by media sensor 328 because lever 332 will not rotate sufficiently in the gap between units of paper 12 to generate a change in the signal supplied to sensor controller 336. Therefore, for imaging operations performed in the second mode, the trailing edge and the leading edge of units of paper 12 will be detected in a different way.

The decision to perform imaging operations in the first mode or the second mode is made by processor 320 according to information received from driver software operating in a computer. Generally, an imaging operation is started after a user generates data in an application program or opens a file using the application program. The driver software is executed when the user elects to print the data generated in the application. As part of the function of the driver software, information specifying the number of units of media upon which images will be formed is passed to processor 320.

Ideally, processor 320 would decide to operate in the second mode if three or more units of media were included in the imaging operation. However, processor 320 cannot make a decision regarding operation in either the first mode or the second mode until information relating to the number of units in the imaging operation is passed to processor 320 from the computer executing the driver software. The time at which this information is passed depends upon the operating system of the computer. The information is supplied by the driver operating within the computer. The information corresponds to the number of pages in the imaging operation that have been rendered by the driver.

The drivers operating in different operating systems may report the rendering of pages differently. In the MICROSOFT WINDOWS NT operating system, the number of pages in imaging operation is rendered and then reported. However, in the MICROSOFT WINDOWS 98 operating system, the number of pages rendered can be reported before all the pages in the imaging operation have been rendered. The firmware executing in processor 320 makes a determination to operate in the first or second mode using the information supplied by the driver. To correctly make the decision to operate in the first mode or the second mode in the WINDOWS 98 operating system the firmware checks the number of pages rendered by the driver. For example, if the driver operating in WINDOWS 98 reported that 3 pages had been rendered, but the rendering operation was not complete, then the firmware would decide to operate in the second mode. The default mode in which inkjet printer 10 performs imaging operations is the first mode. Until processor 320 decides that imaging operations should be performed in the second mode, inkjet printer 10 operates in the first mode.

Operation in the second mode is only performed on imaging operations using letter size paper or A4 size paper. Because of this, the decision to operate in the second mode is made after an imaging operation is performed on the first unit of paper 12 in the imaging operation and the length of the first unit of paper 12 can be measured. Shown in FIG. 6A through FIG. 6H is a high level flow diagram corresponding to an exemplary imaging operation in inkjet printer 10 performed using the second mode. First, in step 400, a first unit of paper 12 is moved into the media path. Next, in step 402, processor 320 commands media movement controller 318 to begin moving the first unit of paper 12 up to a predetermined distance at a predetermined rate (in one embodiment of the media movement apparatus the move can correspond to up to 30,000 counts of rotary position encoder 316 at 20 inches per second). Next, in step 403 processor 320 polls sensor controller 336. Then, in step 404, processor 320 determines if media sensor 328 has detected the leading edge of the first unit of paper 12. If it has not, then control is returned to step 403. If it has detected the leading edge of the first unit of paper 12, then, in step 406, processor 320 commands media movement controller 318 to move the first unit of paper 12 an additional predetermined distance from the location at which the leading edge was detected to bring the leading edge to the input side of the print zone (in one embodiment of the media movement apparatus this additional predetermined distance corresponds to 4500 counts of rotary position encoder 316). Then in step 407, processor 320 establishes the rotary position encoder count at the location where the leading edge of the first unit of paper 12 is at the input side of the print zone. Next, in step 408, inkjet printer 10 begins forming image is formed on the first unit of paper 12 corresponding to data generated by an application program executed on a computer by moving carriage 300 across the media path and ejecting ink from print cartridges 302 onto the first unit of paper 12.

While formation of the image on the first unit of paper 12 is underway, processor 320, in step 410, polls sensor controller 336. In step 412, processor determines if the trailing edge of the first unit of paper 12 has been detected from the results of polling sensor controller 336. If the trailing edge is not detected, control is returned to step 410 to continue to poll sensor controller 336 while the image continues to be formed on the first unit of paper 12 is underway. The region on units of paper 12 on which ink can be placed is the imaging zone. There are four boundaries for the imaging zone. The two boundaries of the imaging zone that are substantially perpendicular to the direction of the media path will be referred to as the leading edge and the trailing edge of the imaging zone. If the trailing edge of the first unit of paper 12 is detected, processor 320 determines, in step 414, the number of counts of rotary position encoder 316 (that is, incremental rotational movements of servo motor 312) until the trailing edge of the imaging zone reaches the output side of the print zone.

Next, in step 416, processor 320 polls media movement controller 318 to receive the count from rotary position encoder 316. Then, in step 418, processor 320 determines if the trailing edge of the imaging zone on the first unit of paper 12 has reached the output side of the print zone. If the trailing edge of the imaging zone has not reached the output side of the print zone, then control is returned to step 416. If the trailing edge of the imaging zone has reached the output side of the print zone, then, in step 420, processor 320 stops the formation of the image on the first unit of paper 12. Next, in step 422, processor 320 determines the length of the first unit of paper 12 using the encoder counts corresponding to detection of the leading edge and the trailing edge by media sensor 328. There are predetermined count values (representing the media lengths) corresponding to each of the types media used. The media type (and the length of the media type in terms of count values) on which the imaging operation will be performed is determined by determining which of the predetermined count values is with +/−500 counts of the measured length of the first unit of paper 12. Next, in step 424, the first unit of paper 12 is ejected into output tray 16.

In step 425, processor determines that the imaging operation should be performed in the second mode using the information supplied by the driver and causes member 104 to move out of contact with pressure plate 102 to enter the second mode of operation. In step 426, media movement controller 318 begins moving a second unit of paper 12 through the media path. This movement can be up to a predetermined distance. Then, in step 428, processor 320 polls sensor controller 336 as the second unit of paper 12 moves through the media path.

Next, in step 430, processor 320 determines if the leading edge of the second unit of paper 12 has been detected. If the leading edge is not detected control is returned to step 428. If the leading edge is detected, then, in step 432, the second unit of paper 12 is moved a predetermined distance until the leading edge of the imaging zone is at the input side of the print zone. Next, in step 434, processor 320 determines the count of rotary position encoder 316 at which the trailing edge of the imaging zone on the second unit of paper 12 will reach the output side of the print zone of print cartridges 302. This is done using the predetermined number of counts for the length of the media type used, the known distance, in terms of counts of rotary position encoder 316, between the location at which media sensor 328 detects the leading edge and the output side of the print zone, and the count of rotary position encoder 316 when the leading edge of the second unit of paper 12 is detected. For the purpose of determining the count of rotary position encoder 316 in step 434, it is assumed by the firmware (based upon information form the driver software) that when performing imaging operations in the second mode, each of the units of paper 12 is of the same size class, for example, letter size paper. The time at which the trailing edge of the imaging zone of the second unit of paper 12 is at the output side of the print zone is determined this manner because media sensor 328 cannot be relied upon to sense the trailing edge of the second unit of paper 12 in the second mode of operation.

Next, in step 436, inkjet printer 10 begins forming an image on the second unit of paper 12 corresponding to data generated by an application program executed on a computer by moving carriage 300 across the media path and ejecting ink from print cartridges 302 onto the second unit of paper 12 while the second unit of paper 12 is being advanced through the print zone. Then, in step 438, media movement controller 318 begins moving a third unit of paper 12 into the media path. While the image is formed on the second unit of paper 12, processor 320, in step 440, polls media movement controller 318 to receive the count supplied by rotary position encoder 316. Next, in step 442, processor 320 determines if the trailing edge of the imaging zone on the second unit of paper 12 has reached the output side of the print zone for print cartridges 302. If the trailing edge of the imaging zone on the second unit of paper 12 has not reached the output side of the print zone, control is returned to step 440.

If the trailing edge of the imaging zone on the second unit of paper 12 has reached the output side of the print zone, then in step 444, processor 320 stops forming an image on the second unit of paper 12. Then, in step 446, processor 320 commands media movement controller 318 to begin moving the second unit of paper 12 and the third unit of paper 12 at the high speed of the velocity profiles shown in FIG. 7. The velocity profile shown in FIG. 7 permits ejection of the second unit of paper 12 while preventing contact with the third unit of paper 12. The speed in region 600 depends upon the fraction of the length of the imaging zone upon which ink is placed. If ink is placed on a large fraction of the length of the imaging zone, then the units of paper 12 are moved at 25 inches per second. Otherwise, the units of paper 12 are moved at 30 inches per second. In one embodiment of the media movement apparatus, with less than 22 millimeters remaining until the trailing edge of the unit of paper 12 reaches the pinch roller movement is done at 25 inches per second. With 22 millimeters or more remaining movement is done at 30 inches per second.

In step 448, processor 320 polls media movement controller 318. Then, in step 450, processor 320 determines (by looking at counts from rotary position encoder 316) if the trailing edge of the second unit of paper 12 reaches the nip region between the pinch rollers using the count of rotary position encoder 316 obtained from media movement controller 318 at the detection of the leading edge of the second unit of paper 12, the length of the second unit of paper 12, and the known distance from lever 332 of media sensor 328 to the nip region. If the trailing edge of the second unit of paper 12 has not reached the nip region, control is returned to step 448. If the trailing edge of the second unit of paper 12 has reached the nip region, processor 320 commands, in step 452, media movement controller 318 to decelerate movement of the third unit of paper 12 at the rate shown in region 602. The rate at which the deceleration occurs is determined empirically to allow the second unit of paper 12 to move out of the media path. In step 454, processor 320 polls media movement controller 318 to determine the count of rotary position encoder 316. Next, in step 456, processor 320 determines if the third unit of paper 12 has moved a predetermined distance corresponding to a predetermined number of counts of rotary position encoder 316. If it has not, control is returned to step 454. If the third unit of paper 12 has moved the predetermined distance, then, in step 458, processor 320 commands media movement controller 18 to stop the movement of the third unit of paper 12.

Figure 7:
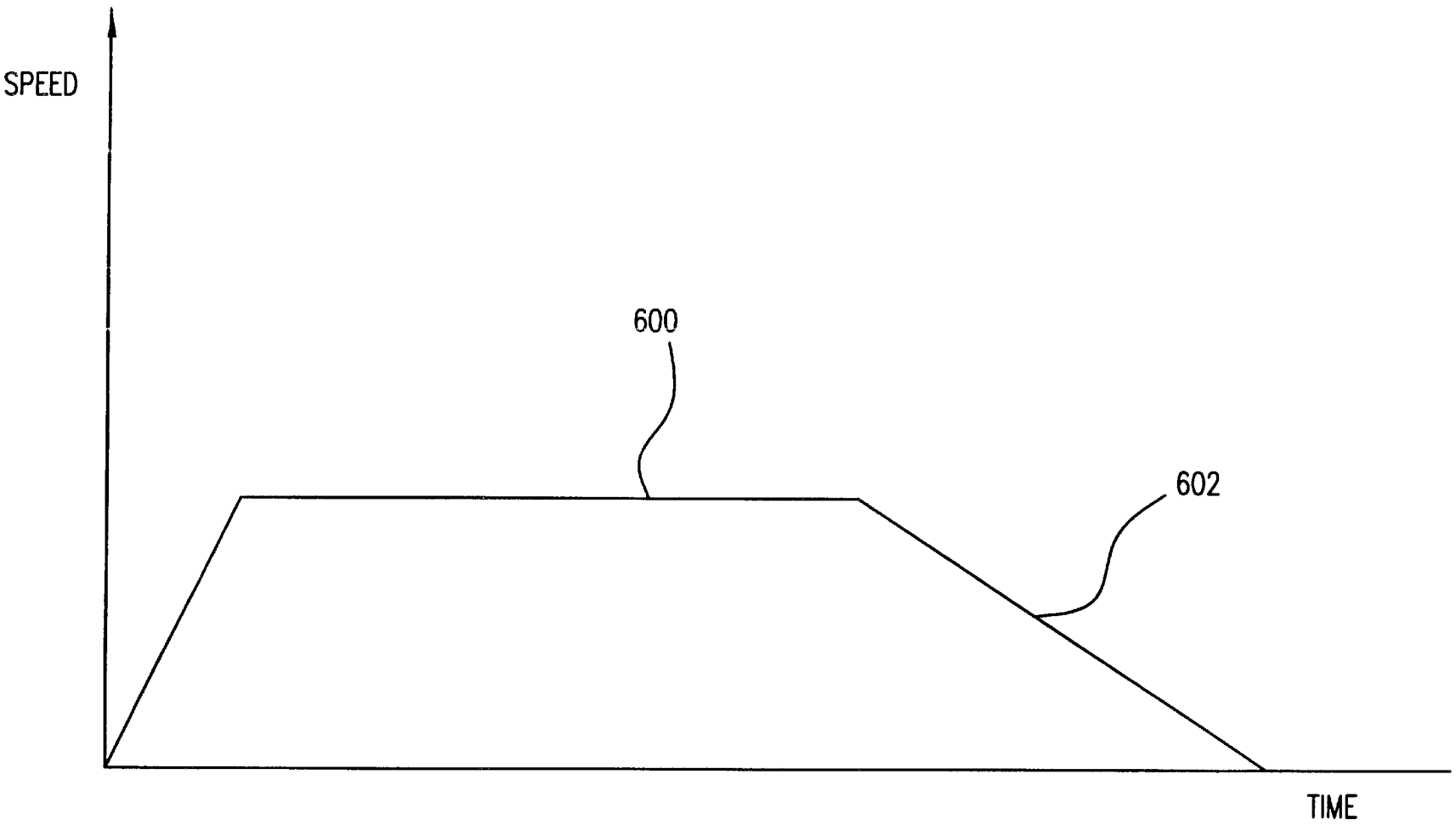
FIG. 7 shows a velocity of profile of units of media in the media path of the inkjet printer.

The speed in region 600 moves the second unit of paper 12 sufficiently fast so that its momentum carries it into output tray 16 without requiring the use of the media ejection mechanism. The deceleration rate region 602 is done to permit the second unit of paper 12 to move toward the output tray without contacting the third unit of paper 12 following closely behind it. Contact between successive units of paper 12 in the media path increases the likelihood that a media jam can result. The deceleration rate shown in FIG. 7 is empirically determined from the objective of having the third unit of paper 12 gently contact the second unit of paper 12 as it is ejected from the media path. The speed profile could achieve the desired objectives with a wide range of media acceleration and deceleration rates. In addition, although inkjet printer 10 uses a particular speed in region 600 and a particular deceleration rate in region 602, it should be recognized that other speed profiles may be used. The important characteristic of the speed profile is that it imparts sufficient momentum to units of media to move them into the output tray while reducing the likelihood of a strong impact between successive units of media in the media path. The mechanical configuration of other printers may make a different velocity profile appropriate.

As a result of the movement of the third unit of paper 12 the predetermined distance, it is possible that the leading edge of the third unit of paper 12 will move into the print zone. Because media sensor 328 did not determine the position of the leading edge of the third unit of paper 12, the leading edge needs to be located and moved to the proper location before an imaging operation can be performed. There are several primary possibilities for the positional relationship in the media path between the second unit of paper 12 and the third unit of paper 12 following it. A first possibility is that there is a gap of sufficient width between these units of paper 12 so that the leading edge of the third unit of paper 12 does not move beneath the optical sensor 330 (located within the print zone) after movement of the third unit of paper 12 is stopped. A second possibility is that the gap between these units of paper 12 is sufficiently small so that the leading edge of the third unit of paper 12 is in the print zone after movement of the third unit of paper 12 is stopped. A third possibility is that there is sufficient overlap between the second unit of paper 12 and the third unit of paper 12 so that executing the move associated with the speed profile of FIG. 7 pushes the leading edge of the third unit of paper 12 well beyond the input side of the print zone of print cartridges 302.

The second possibility is the most frequently occurring. The firmware initially operates assuming that the second possibility has occurred. For this case, the leading edge of the third unit of paper 12 has moved within the range that can be detected by optical sensor 330. In step 460, the firmware controlling processor 320 commands media movement controller 318 to begin moving the third unit of paper 12 backwards in the media path. In step 462, processor 320 polls sensor controller 336 to obtain the output from optical sensor 330. With a unit of paper 12 located below optical sensor 330, the value returned from optical sensor 330 will be close to the maximum possible value (a value of 256 for an embodiment of optical sensor 330 that could be used in inkjet printer 10). With no unit of paper 12 located below optical sensor 330, the value returned from optical sensor 330 will be close to the minimum possible value (a value of 0).

Next, in step 464, processor 320 determines if the leading edge of the third unit of paper 12 has been detected using the collected values of the output from optical sensor 330. In one embodiment of the media movement apparatus, the position of the leading edge is determined as the position of the third unit of paper 12 when the value generated by optical sensor 330 decreases by a value of 50. However, it should be recognized that other values of change may be used to detect edges depending upon the characteristics of the sensor, the media, and the surface illuminated by the sensor without the media present. If the leading edge is not detected, then in step 466, processor 320 polls media movement controller 318. Next, in step 468, processor 320 determines if the third unit of paper 12 has moved a predetermined distance backward in the media path. In one implementation of the media moving apparatus, the predetermined distance corresponds to 1500 counts of rotary position encoder 316. If the third unit of paper 12 has not moved the predetermined distance backward, then control is returned to step 462. If the third unit of paper 12 has moved the predetermined distance, then, in step 470, processor 320 commands media movement controller 318 to stop movement of the third unit of paper 12.

If the leading edge is detected, then, in step 472, movement of the third unit of paper 12 is stopped and then control is transferred to step 500. If in step 468, processor 320 determines that the third unit of paper 12 moves backward in the paper path the distance corresponding to the predetermined number of counts without detecting the leading edge of the third unit of paper 12, then there are two primary options corresponding to the previously mentioned first possibility and third possibility. The first possibility is that the gap between the second unit of paper 12 and the third unit of paper 12 was sufficiently large so that after completion of the move associated with the speed profile of FIG. 7, the leading edge of the third unit of paper 12 was behind optical sensor 330 in the media path. The third possibility is that the leading edge of the third unit of paper 12 had advanced so far in the media path that the movement backward the maximum distance was not sufficient to place the leading edge behind optical sensor 330 in the media path (as would occur when the third unit of paper 12 overlapped the second unit of paper 12), thereby preventing detection of the leading edge.

To distinguish between these possibilities, in step 472, the firmware controlling processor 320 polls sensor controller 336. Then, in step 474, processor 320 determines if the third unit of paper 12 is present below optical sensor 330. If the value corresponds to the presence of the third unit of paper 12 (at the high end of the 0 to 256 range), then it is likely that there was overlap between the second unit of paper 12 and the third unit of paper 12. If the third unit of paper 12 is below optical sensor 330, then control is transferred to step 500 because there was overlap between the second unit of paper 12 and the third unit of paper 12.

If the value corresponds to the absence of the third unit of paper 12 below optical sensor 330 (that is, the value is at the low end of the 0 to 256 range), then it is likely that there was a large gap between the second unit of paper 12 and the third unit of paper 12 that prevented the third unit of paper 12 from reaching the position below optical sensor 330. In that case, in step 476, processor 320 commands media movement controller 318 to begin moving the third unit of paper 12 forward in the media path up to a predetermined distance so that the leading edge of the third unit of paper 12 is likely pass beneath optical sensor 330. For one embodiment of the media movement apparatus, this predetermined distance is empirically determined to correspond to a move of 30,000 counts of rotary position encoder 316. Although the move of up to 30,000 counts corresponds to nearly an entire unit of paper 12 in one embodiment of the media movement apparatus, the gap between successive units of paper 12 will almost always be much less than this. Typically, the gap between successive units of paper 12 will not exceed the circumference of the drive roller in inkjet printer 10.

In step 478, processor 320 polls optical sensor 336 to obtain the measurement generated by optical sensor 330. Next, in step 480, processor 320 determines if the leading edge of the third unit of paper 12 has been detected. If the leading edge of the third unit of paper 12 is detected, then, in step 482, movement of the third unit of paper 12 is stopped and then control is transferred to step 490. If the leading edge of the third unit of paper 12 is not detected, then, in step 484, processor 320 polls media movement controller 318 to obtain a value from rotary position encoder 316. Next, in step 486, processor 320 determines if the third unit of paper 12 has moved the predetermined distance forward in the media path. If it has not, control is returned to step 478. If the third unit of paper 12 has moved the predetermined distance forward in the media path and the leading edge has not been detected, there could be a problem with optical sensor 330, a media jam, or some other unanticipated event. In this case, in step 488, processor stops attempting to move of the third unit of paper 12 and signals that there is a media jam.

If in step 480, the leading edge of the third unit of paper 12 is detected, then in step 490, processor 320 commands media movement controller 318 to begin moving the third unit of paper 12 forward in the media path a predetermined distance. In one embodiment of the media movement apparatus, this predetermined distance corresponds to 900 counts of rotary position encoder 316. Then, in step 492, processor 320 polls media movement controller 318. Next, in step 494, processor 320 determines if the third unit of paper 12 has moved forward the predetermined distance. If it has not, then control is returned to step 492.

In one embodiment of the media movement apparatus, this predetermined distance forward corresponds to 900 additional counts of rotary position encoder 316. This additional advance is to move the third unit of paper 12 forward so that the leading edge of the third unit of paper 12 can be located by moving the third unit of paper 12 backward. It is desirable to have the leading edge of units of paper 12 positioned at substantially the same location after detection of the leading edge. To accomplish this using one embodiment of the optical sensor 330, the edge on the third unit of paper 12 is detected while it is moving backward in the media path. Detecting the leading edge of units of paper 12 while moving backward is done in one embodiment of the media movement apparatus because of the characteristics of optical sensor 330. Detecting the position of the leading edge with optical sensor 330 while moving the third unit of paper 12 forward in the media path will not provide the same location of the leading edge as when detection is done while moving the third unit of paper 12 backward in the media path. It should be recognized that with a different position of the optical sensor in the media path relative to the print zone, detection of the leading edge may be done with units of paper 12 moving either forward or backward in the media path. If, in step 494, processor 320 determines that the third unit of paper 12 has been moved forward the predetermined distance, then control is returned to step 460.

If, in step 464, the leading edge of the third unit of paper 12 is detected while moving it backward, then control is transferred to step 496. In step 496, processor 320 commands media movement controller 318 to move the leading edge of the third unit of paper 12 to the input side of the print zone. The distance from the location at which the leading edge is located using optical sensor 330 to the input side of the print zone of print cartridges 302 is available to the firmware as a predetermined value for inkjet printer 10. Next, in step 498, an image is formed on the third unit of paper 12.

If from step 474, the third unit of paper 12 is detected below optical sensor 330, then this corresponds, most likely, to overlap between the second unit and the third unit of paper 12. For this case, the firmware shifts operation of inkjet printer 10 from the second mode back to the first mode. In step 500, the firmware executing in processor 320 moves member 104 into contact with pressure plate 102 and commands media movement controller 318 to move all units of paper 12 in the media path into output tray 16. In step 502, processor 320 commands media movement controller 318 to begin moving the third unit of paper 12 out of the media path. While the media path is clearing, in step 504, processor 320 polls sensor controller 336 to detect the trailing edge of the third unit of paper 12. Next, in step 506, processor 320 determines if the trailing edge of the third unit of paper 12 has been detected. If it has not, control is transferred to step 504. If the trailing edge has been detected, then in step 508, processor 320 commands media movement controller 318 to move the trailing edge of the third unit of paper to the nip region between the pinch rollers and eject it in to the output tray. Next, in step 510, processor 320 determines whether imaging on the remaining units in the imaging operation will be performed in the second mode. If the imaging operation is to be done in the first mode, in step 512, the imaging operation is completed in the first mode. If the imaging operation is to be completed in the second mode, control is returned to step 425.

Although an embodiment of the media movement apparatus has been illustrated and described, it is readily apparent to those of ordinary skill in the art that various modifications may be made to this embodiment without departing from the scope of the appended claims.

What is claimed is:

1. A method for locating an edge of media in an inkjet imaging device having a media path, comprising:

moving the media backward in the media path;

making a plurality of measurements of light reflected from within the media path while moving the media backward; and stopping movement of the media if the plurality of measurements indicates detection of the edge.

2. The method as recited in claim 1, further comprising:

moving the media forward in the media path after detecting the edge.

3. The method as recited in claim 2, further comprising:

stopping movement of the media if the media travels backward in the media path a predetermined distance without detection of the edge.

4. The method as recited in claim 3, further comprising:

making a measurement of the light reflected from within the media path if the media travels backward in the media path the predetermined distance;

moving the media forward in the media path if the media travels backward in the media path the predetermined distance and the measurement indicates the absence of the media;

making a second plurality of measurements of the light reflected from within the media path while moving the media, with the plurality of measurements corresponding to a first plurality of measurements; and moving the media forward a second predetermined distance if the second plurality of measurements indicates detection of the edge, with the predetermined distance corresponding to a first predetermined distance.

5. The method as recited in claim 4, further comprising:

moving the media out of the media path if the media travels backward in the media path the first predetermined distance without detection of the edge and the measurement indicates the presence of the media.

6. The method as recited in claim 5, further comprising:

stopping movement of the media and signaling a fault condition if the media travels forward a third predetermined distance without detection of the edge.

7. The method as recited in claim 6, further comprising:

moving the media backward in the media path after moving the second predetermined distance;

making a third plurality of measurements of the light reflected from within the media path while moving the media; and stopping movement of the media if the third plurality of measurements indicates detection of the edge.

8. The method as recited in claim 7, further comprising:

moving the media forward a fourth predetermined distance if the first plurality of measurements or the third plurality of measurements detects the edge; and forming an image on the media.

9. The method as recited in claim 8, further comprising:

moving a first unit of the media and a second unit of the media at a substantially constant speed for a first interval to move the first unit of media out of a media path; and decelerating the second unit of media at substantially a predetermined rate for a second interval, with the media corresponding to the second unit of the media and with moving at the speed and decelerating at the predetermined rate occurring prior to moving the second unit of media backward in the media path.

10. An apparatus to move media in an inkjet imaging device, comprising:

a sensor configured to measure light reflected from the media;

a media movement mechanism configured to move the media in a media path; and a processing device arranged to receive a plurality of measurements of light reflected from within the media path from the sensor and configured to command the media movement mechanism to selectively move a first unit of the media backward or forward in the media path to detect an edge of the media using the plurality of measurements and configured to command the media movement mechanism to move the first unit of the media and a second unit of the media at a substantially constant speed for a first interval and to decelerate the second unit of media at substantially a predetermined rate for second interval.

11. The apparatus as recited in claim 10, wherein:

the processing device includes a configuration to command the media movement mechanism to move the second unit of media backward in the media path after the second interval while making the plurality of measurements.

12. The apparatus as recited in claim 11, wherein:

the processing device includes a configuration to command the media movement mechanism to move the second unit of media forward in the media path after detection of the edge.

13. The apparatus as recited in claim 12, wherein:

the media moving mechanism includes a media movement controller coupled to a motor.

14. The apparatus as recited in claim 13, further comprising:

a sensor controller coupled to the sensor and the processing device.

15. An imaging device, comprising:

a printhead to eject ink onto media;

a printhead controller configured to provide a signal to the printhead to eject ink according to image data;

a sensor configured to measure light reflected from the media;

a media movement mechanism configured to move the media in a media path; and a processing device arranged to receive a plurality of measurements of light reflected from within the media path from the sensor and configured to command the media movement mechanism to selectively move a first unit of the media backward in the media path or forward in the media path dependent upon the sensor indicating an absence of the first unit of the media in the media path from the plurality of measurements, configured to command the media movement mechanism to move the first unit of the media and a second unit of the media at a substantially constant speed for a first interval and to decelerate the second unit of the media at substantially a predetermined rate for a second interval, and configured to supply the image data to the printhead controller.

16. The apparatus as recited in claim 15, wherein:

the processing device includes a configuration to command the media movement mechanism to move the second unit of media forward in the media path with the plurality of measurements indicating the absence of the second unit of media.

17. The apparatus as recited in claim 16, wherein:

the processing device includes a configuration to detect an edge of the second unit of media using the plurality of measurements during movement of the second unit of media forward or backward in the media path.

18. The apparatus as recited in claim 17, wherein:

the processing device includes a configuration to command the media movement mechanism to move the second unit of media forward in the media path to a position opposite the printhead after detection of the edge.

* * * * *